United States Patent [19]

Tyree, Jr. et al.

[11] Patent Number: 4,783,972

[45] Date of Patent: Nov. 15, 1988

[54] $N_2$ TUNNEL FREEZER

[75] Inventors: Lewis Tyree, Jr., Oak Brook; Martin M. Reynolds, Aurora; Gary D. Lang, Naperville, all of Ill.

[73] Assignee: Liquid Carbonic Corporation, Chicago, Ill.

[21] Appl. No.: 114,228

[22] Filed: Oct. 29, 1987

[51] Int. Cl.[4] ..... F25D 17/02

[52] U.S. Cl. ..... 62/374; 62/186; 62/380; 236/49

[58] Field of Search ..... 62/186, 374, 380, 63; 236/490

[56] References Cited

U.S. PATENT DOCUMENTS

| | | | |
|---|---|---|---|
| 3,553,973 | 1/1971 | Moran | 62/380 |
| 4,059,046 | 11/1977 | Yamazaki et al. | 62/380 |
| 4,229,947 | 10/1980 | Klee | 62/380 |
| 4,237,695 | 12/1980 | Oberpriller et al. | 62/380 |
| 4,276,753 | 7/1981 | Sandberg et al. | 62/380 |
| 4,403,479 | 9/1983 | Rasovich | 62/374 |
| 4,498,309 | 2/1985 | Kobayashi et al. | 236/490 |
| 4,589,264 | 5/1986 | Astrom | 62/380 |

*Primary Examiner*—Ronald C. Capossela
*Attorney, Agent, or Firm*—Fitch, Even, Tabin & Flannery

[57] ABSTRACT

A cryogenic freezer having a thermally insulated tunnel-like enclosure with an entrance and an exit and means for conveying products being frozen therethrough. Products are contacted with liquid cryogen at a region generally near the entrance and a blower located closer to the entrance than to the exit controls flow of cryogen vapor. Upstream and downstream baffles and dampers associated with blower are linked together for complementary movement to selectively regulate the upstream and downstream flow of vapor discharged from the blower. Additional blowers circulate the cold cryogenic vapor transverse to the direction of the conveying means. The temperature of vapor leaving the region of the entrance is monitored the orientation of the baffle and damper arrangement is adjusted in accordance with the temperature monitored. The food products can be contacted by liquid nitrogen in a reservoir facilitates cleaning and retards inefficient vaporization.

20 Claims, 2 Drawing Sheets

$N_2$ TUNNEL FREEZER

This invention relates to cryogenic freezing and more specifically to cryogenic freezing using a liquid cryogen, such as liquid nitrogen.

BACKGROUND OF THE INVENTION

Cryogenic freezing of food products has become more and more frequently used and has become particularly useful for freezing food products having surface characteristics which should appear aesthetically attractive following freezing. Because cryogenic freezing must compete with other types of freezing in the economic marketplace, it is important that cryogenic freezing be carried out in a particularly efficient manner. One way of improving efficiency is to incorporate the ability to supply the cryogenic refrigeration to the food product in a manner which matches the rate at which the food product can accept such refrigeration and give off its internal heat. For many such products, the rate at which the product can accept cooling is the greatest initially, and accordingly the freezing of such products can be most efficiently carried out using apparatus which initially extracts heat therefrom at a very fast rate. Side benefits of achieving such efficiency include the preservation of texture and prevention of dehydration.

There are also needs for apparatus which can freeze discrete particulate material as opposed to the freezing of hamburgers or the like which are fashioned into patties and generally maintained in an ordered array upon a conveyor belt or the like. As in the case of handling all food products, cleanliness if important, and the ability of apparaus to be cleansed in an efficient manner at the end of a particular operation also constitutes an important feature. Although many versions of apparatus have been developed for freezing food products of this general type, such apparatus have met with less than total success, and it is desirable to provide cryogenic freezing apparatus having improved features and which can freeze food products more efficiently than apparatus currently in use.

SUMMARY OF THE INVENTION

The invention provides a tunnel-like cryogenic freezer designed for use with a liquid cryogen, particularly liquid nitrogen. As standard with tunnels of this type, an elongated, thermally insulated enclosure is provided having an entrance and an exit and means for conveying the food products to be frozen longitudinally from one end to the other. Food products are contacted with a liquid cryogen at a region generally adjacent to the entrance end so that the products are relatively promptly exposed to liquid cryogen, which has capacity for removing heat therefrom at the greatest rate, when the food is best able to give up such heat. The tunnel also includes means for directing the flow of vapor therein so that the refrigeration value of this cold cryogen vapor is efficiently utilized in extracting heat from the products being frozen. One particular freature of apparatus of the invention is the incorporation of a system for very efficiently directing the cryogenic vapor in a manner to prevent the ingress of undesirable humidity-bearing air while at the same time assuring that good use is made of the refrigeration value of the cryogenic vapor. Pursuant to this feature, the temperature of exhaust gas leaving the entrance region of the freezer is monitored, and the results of this monitoring are used to appropriately adjust the flow of cryogenic vapor throughout the tunnel.

Another particular feature of the apparatus is the incorporation of a basin for holding liquid cryogen which is constructed in a manner to direct the movement of food products being delivered to the basin toward an inclined conveyer which lifts the food products from the liquid cryogen within the basin and in turn delivers them to the loading end of a mina conveyor which extends longitudinally toward the exit end of the tunnel. The construction and the mounting of this basin facilitates its cleaning.

DETAILED DESCRIPTION OF THE PREFERRED EMBODIMENTS

Figure 1:
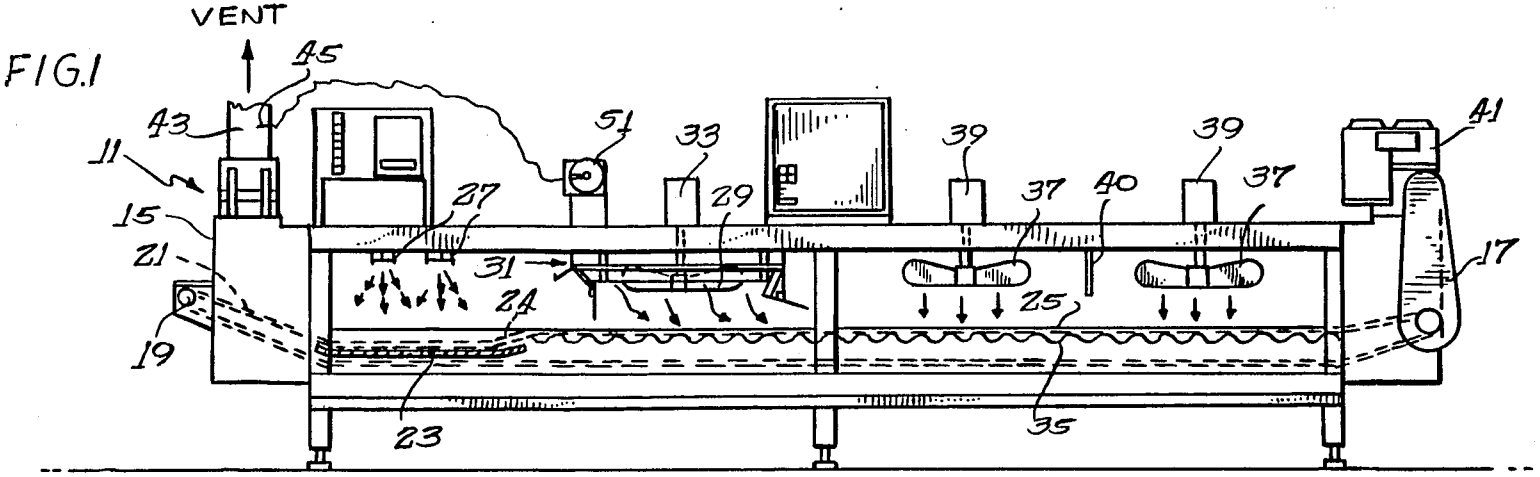
FIG. 1 is a side view of cryogenic freezing apparatus incorporating various features of the invention, with the side panels omitted so as to illustrate the working region of the tunnel-like freezing apparatus.

Shown in FIG. 1 is a cryogenic freezing apparatus 11 which includes an elongated tunnel 13 that is formed with thermally insulated side, top and bottom walls and which has an entrance end 15 and an exit end 17. A single belt conveyor 19 carries the food products throughout the entire length of the tunnel freezer. This conveyer 19 has an initial downwardly inclined section 21, which dips into a shallow basin 23, a short transition section 24 and a generally horizontal main section 25 which travels substantially the remaining length of the freezer to the exit 17. The shallow basin 23 collects any liquid cryogen sprayed onto the food products being carried by the conveyer belt 19 that does not immediately evaporate, which spraying is carried out through a plurality of liquid cryogen nozzles 27 located above the shallow basin 23 near the entrance end of the tunnel 13. As an alternative, one or more of such nozzles 27 can be located vertically below the belt so that the cryogenic liquid spray therefrom is directed against the undersurfaces of the food products.

The flow of the cold cryogenic vapor within the tunnel 13 is controlled by a main blower 29 and an associated baffle arrangement 31. The blower 29 is powered by a rotary motor 33 whch is preferably located above the insulated top wall of the tunnel and which is designed to power the blower fan in a direction so as to force cryogenic vapor vertically downward onto the food products being carried beneath it on the conveyer belt 19. The downwardly directed cryogenic vapor from the fan 29 first contacts the upper surfaces of the food products being frozen and flows through the conveyer belt, which is made of a pervious material, and is then deflected back upward by an undulating baffle 35, which is located directly below the upper reach of the main section 25 of the conveyer belt, so that it is directed against the undersurface of the food products on the belt.

Another pair of auxiliary blowers 37 are disposed downstream of the main blower 27 and are likewise powered by rotary motors 39 which are preferably located above the insulated top wall of the tunnel. These auxiliary blowers 37 are likewise operated so as to direct cyrogenic vapor downward onto, and past, the food products being carried therebelow on the main section of the conveyor 25 thereby promoting heat-exchange therebetween. One or more baffles, such as the baffle 40, can be located in the tunnel to create a barrier against the too rapid passage of nitrogen vapor in a downstream direction, thus essentially creating a succession of progressively warmer zones which will promote efficient extraction of the refrigeration quality of the vapor prior to discharge. The conveyer is preferably driven by a suitable drive arrangement 41 that may utilize a gear reduction unit and a chain drive and this is located adjacent the exit end of the freezer.

It is usual to withdraw cryogenic vapor from the exit and entrance ends of the tunnel and cause it to be vented exterior of the building wherein the cryogenic apparatus 11 is located so as not to undesirably dilute the normal oxygen atmosphere which the workers breathe to such an amount that normal breathing would be interfered with. In the illustrated embodiment, a venting duct 43 is provided adjacent the entrance to the tunnel leading to such an exterior location, and a suitable duct (not shown) is provided near the exit end 17. The vent duct 43 contains a blower (not shown), usually located near its outlet, which is driven at a suitable speed so as to withdraw sufficient cryogenic vapor and some ambient air to achieve the aforestated purpose. This blower may be driven with a constant speed motor or with a variable speed motor is there may be large variances in the rate at which cryogen vapor will be created within the tunnel. The temperature of the mixed gas stream being discharged through the venting duct 43 is monitored by an appropriate arrangement, such as a thermocouple 45 which is located in the duct 43. The temperature being monitored is suitably transmitted as a signal to control apparatus 47 which is designed to in turn operate the baffle arrangement 31 so as to effect appropriate adjustments to the relative upstream and downstream flows of vapor, consistent with the reading of the temperature in the vent duct 43 so as to continue to operate at very efficient conditions. Other monitoring devices and/or concepts can alternatively be used; for example, a fixed heat input can be applied to a thermocouple located in the path of the exiting nitrogen vapor stream before it becomes part of the mixed gas stream in the duct 43.

Very generally, the desire is to maintain the temperature of the gas mixture being discharged to the exterior through the vent duct at about a temperature which is representative of containing an amount of cryogenic vapor which assures that there is sufficient cold vapor being withdrawn through the entrance end so that there is substantially no ingress of humidity-bearing air into the tunnel, where cryogenic temperatures exist and where any humidity in such air would immediately turn to frost. Thus, if the temperature being monitored in the discharge duct 43 rises above this representative temperature, it is indicative of an approaching situation where insufficient cryogen vapor is being withdrawn into the duct 43 from the entrance end, and the baffle arrangement 31 is adjusted accordingly so as to direct a greater proportion of the total flow of vapor toward the entrance end 15 of the freezer. On the other hand, if the temperature being monitored drops below the desired representative level, this is indicative that an excess of cryogenic vapor is being withdrawn through the vent duct 43, which would begin to unnecessarily lower the overall efficiency of the apparatus; thus, an appropriate adjustment is made to the baffle arrangement 31 so as to cause a greater proportion of the cryogenic vapor as to be directed downstream. The amount necessary to achieve this effect can vary with the size of the freezer opening which is set to match the shape of the food products being frozen.

Figure 2:
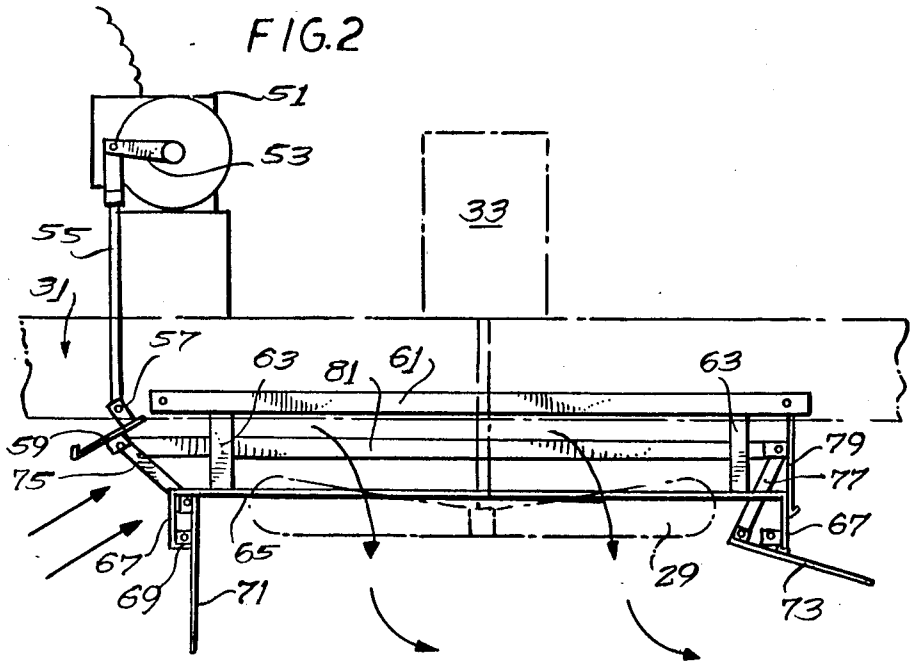
FIG. 2 is a fragmentary view of a portion of the freezer of FIG. 1 specifically illustrating its main blower and an associated baffle system which is used to control the flow of cryogenic vapor within the tunnel, the baffle system being illustrated in the orientation depicted in FIG. 1 so that substantially maximum flow of cryogenic vapor is being directed downstream.
Figure 3:
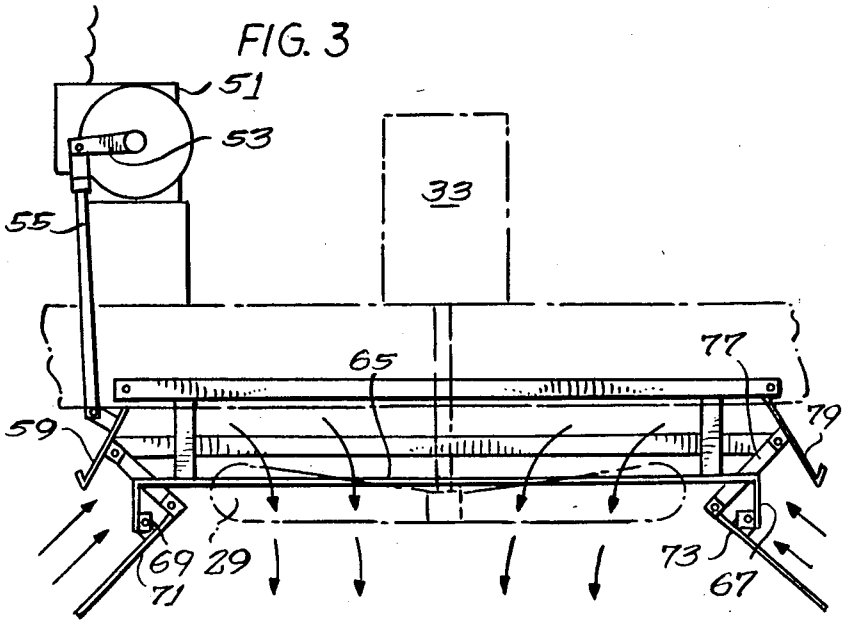
FIG. 3 is a view generally similar to FIG. 2 however showing the baffle system adjusted to an intermediate position wherein the flow of cryogenic vapor is more evenly distributed both upstream and downstream therefrom.

Illustrated in FIGS. 2 and 3 is the specific mechanism that is utilized to achieve the desired adjustment of the interconnected baffle arrangement 31. More specifically, a control motor 51 is provided which receives a signal from the control system 47 telling it to rotate either clockwise or counterclockwise. The control motor carries a rotatable arm 53, and pivotally connected to the end of the arm is a connecting rod 55 which is in turn linked to a bracket 57 which is affixed to an upstream damper 59 that partially controls the suction of cryogenic vapor to the main blower 27. The damper 59 is pivotally mounted at its upper end to a top horizontal member 61 which makes up part of the supporting frame. The frame also includes legs 63 which depend from the horizontal bar 61 and which are in turn affixed to a lower plate 65. The plate 65 is suitably cut out to allow the fan blade 29 to rotate in the vacant center portion thereof. Depending short plates are affixed to the upstream and downstream edges of the main plate 65, and these short plates 67 are provided with brackets 69 to which there are pivotally attached brackets of complementary upstream and downstream baffles 71 and 73. A pair of links 75, 77 connect the upstream damper 59 to the upstream baffle 71 and the downstream baffle 73 to a downstream damper 79 that is appropriately pivotally connected to the downstream end of the horizontal member 61 of the frame. In addition, a horizontal link 81 interconnects the upstream damper 59 and the downstream damper 79.

In the orientation depicted in FIGS. 1 and 2, the baffle arrangement 31 has been adjusted so that the upstream baffle 71 is vertically oriented, thereby providing the maximum blocking or deterrent effect to upstream flow from the main blower 27 and directing by far the major portion of vapor flow downstream past the downstream baffle 73, which is oriented in its most nearly horizontal position where it exerts the least resistance to flow of cryogenic vapor therepast. With the baffles 71 and 73 in this position, it will be noted that the interconnected dampers 59 and 79 are disposed in functionally complementary orientations. The upstream damper 59 is in its most nearly horizontal position and thereby is wide open, allowing the downwardly directed blower 27 to take substantially its entire suction from the region of the tunnel upstream of the blower where cryogen vapor is being created. On the other hand, the downstream damper is in its vertical orientation where it is, in essence, shut and thus avoids any significant suction to the blower from the region of the tunnel downstream of the baffle arrangement 31. With the baffles and the dampers in this orientation, the main, downwardly directed blower 27 takes substantially all of its suction from a region upstream of the blower 27 and directs a major portion of its discharge downstream therefrom so that this vapor ultimately leaves the tunnel through the exit end 17 after its temperature has been raised very substantially through a series of heat exchange passes past the food products being carried on the main section 25 of the conveyer.

If, through temperature monitoring, it is determined that an insufficient amount of cryogen vapor is being vented through the vent duct 43 to assure that the undesired ingress of humidity-bearing air is being avoided, the control system 47 sends a signal to the control motor 51 which causes a counterclockwise rotation of the arm 53 from the position shown in FIG. 2 to the position shown in FIG. 3. As a result of the movement of the control arm 53, the connecting link 55 moves downward causing the upstream damper 59 to pivot to a midway position between its fully open and fully closed positions. This pivotal movement of the damper 59 causes a similar but opposite pivotal movement of the baffle 71, resulting in its being swung from the vertical position shown in FIG. 2 to a midway position shown in FIGJ. 3 where it allows more of the cryogen vapor being discharged from the main blower 27 to flow toward the entrance end 15 of the tunnel. The pivotal movement of the damper 59 also causes a movement to the right of the horizontal connecting link 81, resulting in a pivotal opening of the damper 79 from the fully shut position shown in FIG. 2 to the midway position shown in FIG. 3. This swinging of the damper 79 in a counterclockwise position results in a pivoting of the baffle 73 from the fully open position shown in FIG. 2 to a midway position shown in FIG. 3 where it still allows a substantial amount of the discharge from the blower 27 to be directed downstream toward the exit end of the tunnel. Moreover, as a result of the change in the dampers 59 and 79 from the positions shown in FIG. 2 to the positions shown in FIG. 3, the suction for the main blower 27 is taken about equally from the upstream and the downstream locations. Thus, the change in the baffle arrangement 31 results in an increase in the amount of cryogen vapor being directed toward the entrance end of the tunnel and therefore an increase in the amount of cold cryogen vapor exiting the entrance and flowing into the vent duct 43, lowering the temperatuare of the gas mixture that is being measured by the thermocouple 45 and assuring that there is sufficient exiting cryogen vapor to prevent ingress of ambient air into the interior of the tunnel 13 where it will condense in the form of undesirable frost.

Should the apparatus 11 be shifted to an idle position in between shifts so no food products are being frozen for a short period of time, only minimal spraying would occur and there would be less cryogen vapor being created. Accordingly, the control system 47 might cause the arm 53 to be moved still further downward causing a still larger portion of the cryogen vapor, perhaps even slightly more than half of the cryogen vapor being created, to be directed from the main blower 47 toward the entrance end to again be certain there is sufficient flow of cryogen vapor to prevent the ingress of humidity-laden ambient air.

Likewise, once colder temperatures begin to be sensed in the exit duct 43 by the thermocouple 45, the control system 47 will cause the control arm 53 to be rotated in the opposite or clockwise direction causing a greater amount of the cryogenic vapor to be directed to the exit end of the freezer where its full refrigeration potential is utilized by undergoing multiple heat exchange passes with the food products being moved along the main section of the conveyer 25 as a result of the action of the auxiliary blowers 37 and the underlying undulating baffle 35 which promote direct impingement flow of cold cryogen vapor against both the upper and lower surfaces of the food products being carried along this pervious conveyer.

Figure 4:
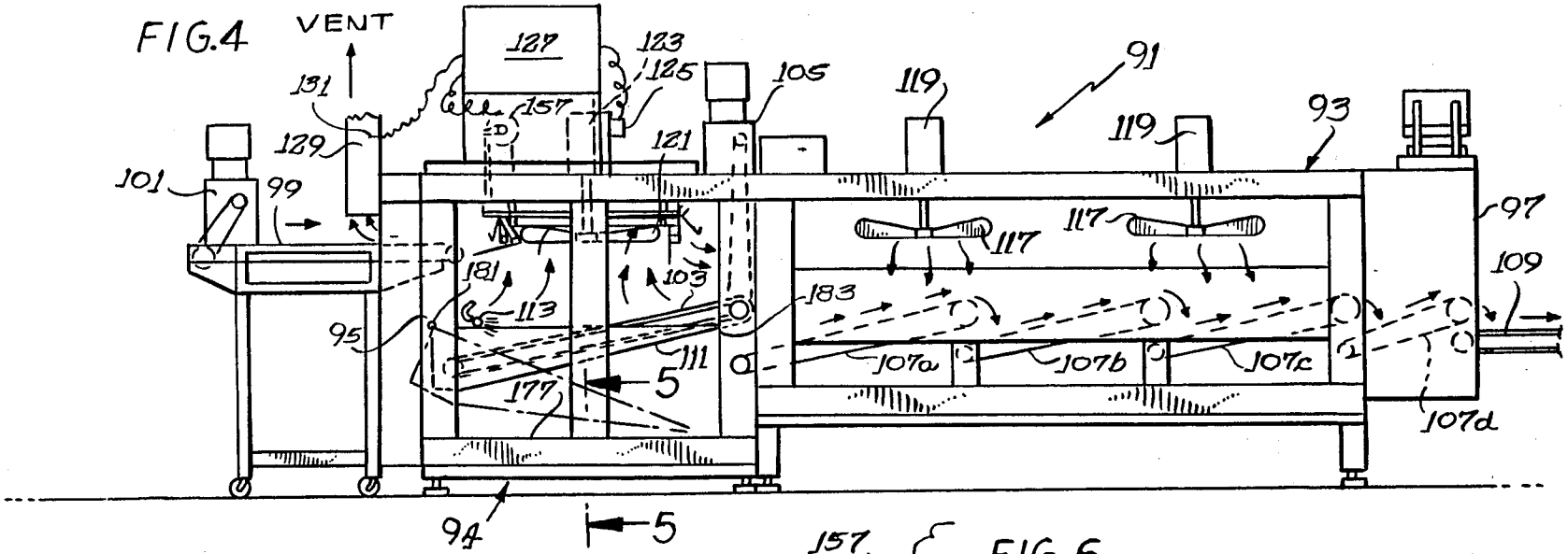
FIG. 4 is a view, similar to FIG. 1, of an alternative embodiment of a cryogenic freezer which also incorporates various features of the invention.

FIG. 4 depicts an alternative embodiment of the cryogenic freezing apparatus that is particularly designed for the freezing of discrete particulate food products that do not need to be specifically oriented along the belt to achieve efficient freezing. Examples of such food products include pieces of chicken or other cut-up poultry or fish, section of fruits or vegetables or the like. More specifically, there is shown a cryogenic freezer 91 which includes an insulated main tunnel section 93 and an upstream extension section 94; the freezer has an entrance end 95 and an exit end 97.

The food products being frozen are supplied to the entrance end of the freezer 91 via a generally horizontal infeed conveyer 101 which is separately driven by an independent drive 103 and extends from ambient into the entrance end 95 of the extension section 94 of the freezer. Thereafter, the food products are transferred serially to a series of inclined conveyer belts as they work their way longitudinally through the freezer 91, giving up their heat to the cold cryogen. More specifically, a first inclined conveyer 103 is powered by a drive unit 105 that is a part of the extension section 94. A series of inclined conveyers 107*a, b, c* and *d* are located within the insulated tunnel 93, and these conveyers carry the food products through to the exit end 97 where they are deposited upon a discharge conveyer 109 or the like.

Located in the extension section 94 is a basin 111 having one relatively deep end in which the upstream or left-hand portion (as viewed in FIG. 4) of the conveyer 103 is located. During operating conditions, a reservoir of liquid cryogen, e.g., liquid $N_2$, is maintained in the basin 111, and the depth of the reservoir is such that preferably half of the conveyer 103 is submerged in the liquid cryogen.

In the embodiment shown, food products of a particulate nature are delivered to the freezer along the infeed conveyer 99, and they vertically drop from its discharge end and fall into the reservoir of liquid cryogen in the basin 111. They have been previously exposed to the cold vapor just prior to and during the fall; however, they immediately contact the cold liquid cryogen across the entire surface area thereof upon entering the reservoir. Depending upon the specific gravity of the food products, they will either float on the surface of the liquid cryogen or will slowly sink below the surface, giving up heat in either instance to the liquid and causing it to vaporize. Fill means 113 is provided for supplying liquid cryogen to the basin, and a suitable level control mechanism (not shown) as is well known in the art is provided to maintain the desired level of the liquid reservoir within the basin 111. The fill means 113 is preferably located and arranged to provide downstream movement in the liquid cryogen reservoir to assist moving the entering food products in the desired direction.

The construction of the basin and the arrangement of the conveyer within it are such as to induce the food products being delivered to its upstream end to be engaged by the upper surface of the moving conveyer belt 103 and slowly carried from the reservoir. The generally clockwise movement of the conveyer belt, as viewed in FIG. 4, creates a downstream current within the upper portion of the reservoir that causes floating food products to move downstream where they will come in contact with the moving belt near where it breaks the surface. If desired, the conveyer belt 103 can be provided with short paddles or dividers which would extend at right angles from the surface of the belt, which paddles will enhance the creation of such downstream currents in the reservoir of liquid cryogen. Morever, the dimensioning of the basin 111 is such that food products which vertically drop from the discharge end of the infeed conveyer 99 will fall onto the submerged conveyer 103 near its upstream end thereof, and if desired, a short deflector could be installed just above the surface of the liquid cryogen level so as to assure the sinking food products will engage the surface of the moving conveyer belt 103. The positioning of this deflector and the feed means 113 can be arranged to cooperate with each other to achieve this objective. The belt on the conveyer 103 is preferably porous so that the liquid cryogen drains from the food products and the belt after they emerge from the reservoir and drips back into the basin. By the time the food products reach the downsteam end of the conveyer 103, they will have become initialy crusted at their surfaces, and the fall from the discharge end of the conveyer 103 onto the feed end of the conveyer 107*a* tends to fracture any weak ice-bonds that might have been formed between the individual food pieces and prevents the bonding of multiple pieces into large agglomerates from occurring.

These food products then travel the length of the conveyer 107*a* where they are discharged and fall onto the upstream end of the conveyer 107*b* and in turn onto the conveyers 107*c* and 107*d*. Clearly, more or fewer conveyer sections can be used depending upon the products being frozen and the optimum length of freezing time. During the time the food products travel through the tunnel section 93, they are exposed to the cold cryogen atmosphere therewithin, and heat exchange to promote the withdrawal of the residual heat from the food products is promoted by a pair of overhead blowers 117 which are located in the head space of the tunnel above the conveyers and direct the cold cryogen vapor downward onto the products being carried slowly therealong toward the exit end 97. These blowers are powered by rotary electric motors 119, preferably located above the insulated top walls of the tunnel.

To facilitate efficient use of the cold cryogen vapor in withdrawing residual heat from the food products, while at the same time preventing undesirable icing of the freezer by the intrusion of humidity-bearing air, an arrangement is provided bearing some similarity to that described with regard to the freezer 11 shown in FIGS. 1 through 3. A main blower 121 is located in the region above the basin 111 wherein the liquid cryogen reservoir is maintained and is powered by a rotary drive motor 123, again preferably located above the insulated top wall of the tunnel extension. The motor 123 is of a variable speed variety and has a speed control 125 mounted thereon which is connected via suitable wiring to the control system 127. A similar vent duct 129 is located adjacent the entrance end 95 of the freezer, and it is designed to vent the cold nitrogen gas which is flowing out of the entrance end of the freezer 91 together with some ambient air from the same region. Although shown schematically in FIG. 4, the duct 129 may be extended slightly further down so as to be certain to pick up the major portion of the cold nitrogen which is slightly heavier than ambient air. A suction fan (not shown) is likewise provided in the duct 129, preferably at its upper end near where discharge to the atmosphere outside of the building preferably occurs. Likewise, to monitor the temperature of the mixture of gases being evactuated, a temperature sensor, such as a thermocouple 131, is provided somewhere in the duct, and the sensor generates a signal that is transmitted to the control system 127.

Figure 6:
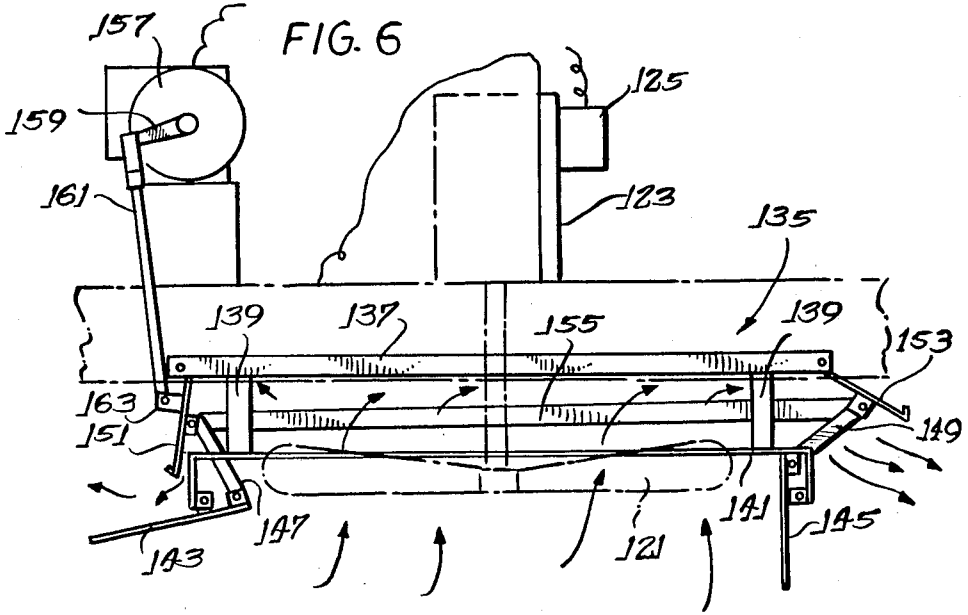
FIG. 6 is an enlarged view, generally similar to FIGS. 2 and 3, illustrating a somewhat similar baffle system which is associated with a blower that is being driven so as to suck cryogenic vapor upward and discharge it radially outward therefrom.

The blower 121 has associated with it a baffle arrangement 135, which is best seen in FIG. 6. The baffle arrangement 135 has a frame which includes upper horizontal members 137 from which short legs 139 depend and, in turn, support a generally horizontal bottom plate 141 which is similarly cut out so the center is open for the blower blade 121 to rotate about its vertical axis. Pivotally mounted on flanges depending from the plate are a pair of lower dampers 143, 145 which are connected by links 147, 149, respectively, to a pair of upper baffles 151, 153. The baffles are pivotally mounted to the upper horizontal members 137 of the frame and are interconnected by a horizontal link 155. To operate the baffle arrangement 135, an electric motor 157 is provided which has a control arm 159, and a connecting rod 161 interconnects the end of the control arm 159 and a bracket 163 mounted on the upstream baffle 151.

In the orientation illustrated in FIG. 6, the damper 145 is in an essentially vertical orientation where it retards suction by the blower of gas from the downstream region of the tunnel extension, whereas the downstream baffle 153 is essentially wide open. Because the blower 131 sucks upward, as opposed to the blower 29 which directs gas downward, the baffles and the dampers are reversed in their vertical locations. Thus, in the orientation shown in FIGS. 4 and 6, the downstream baffle 153 is essentially wide open while the downstream damper 145 is close to a vertical orientation where it significantly retards the suction flow of vapor to the blower 121. On the other hand, the upstream baffle 151 is in its nearly closed position so that only a minor portion of the vapor that is created is being directed upstream along the upper region of the tunnel extension whereas the wide open baffle 153 allows the major portion of the vapor flow to move downstream. Similarly, the damper 143 which is mechanically interconnected with the baffle 151 is close to a horizontal orientation, thus encouraging the suction of vapor rising from the liquid nitrogen reservoir in the basin 111.

Should the temperature being monitored by the senor 131 begin to rise above the preset temperature, which is indicative that the gas mixture being vented contains less than the desired amount of cold cryogen vapor, the control system 127 responds by causing the motor 157 to rotate slightly counterclockwise. This movement of the control arm 159 causes the connecting rod 161 to open the baffle 151 while pivoting the damper 143 slightly toward a more vertical orientation. The effects are two-fold: additional high-pressure vapor from the blower 121 is directed upstream, and slightly more low-pressure vapor rising from the basin is allowed to flow past the damper 143 and out the entrance end of the apparatus. At the same time, the proportion of high-pressure vapor being directed downstream is reduced accordingly.

The apparatus can be shifted to idle position, as, for example, during a lunch break or some other interruption in normal continuous operation, or perhaps during changeover from one product to another, assuming the apparatus is not dedicated to freezing a single product. In idle condition, there is no food product entering via the infeed conveyer 99, and during idle condition, the evaporation of liquid cryogen is desirably retarded so that only about enough liquid nitrogen is evaporated to maintain a positive pressure within the tunnel that will prevent the ingress of humidity-bearing ambient air. Therefore, the blower 121 is caused to rotate relatively slowly by shifting the motor control 125 to the lowest speed and thus eliminating its normal substantial suction effect upon the upper surface of the liquid cryogen reservoir located below it. At the same time, the temperature sensor 121 will sense the slow rise in temperature and will cause the control motor 157 to rotate in a clockwise motion so as to direct more of the cryogen vapor upstream toward the entrance end 95 of the apparatus.

Figure 5:
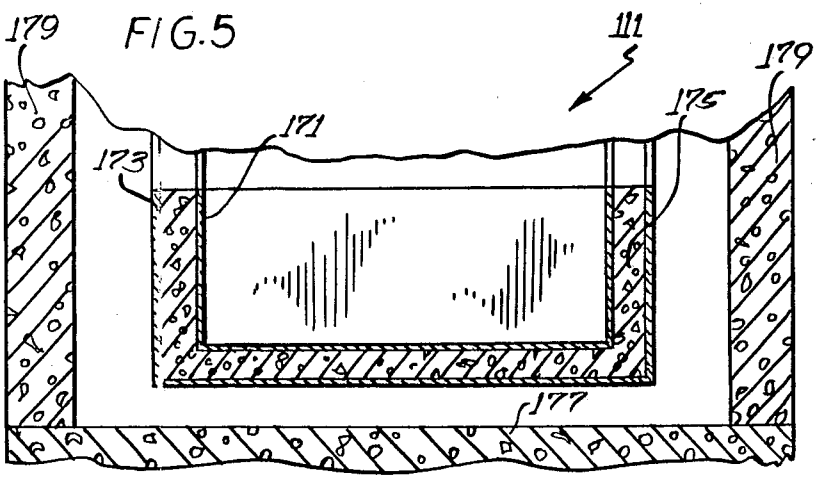
FIG. 5 is an enlarged fragmentary sectional view taken generally along the lines 5—5 of FIG. 4 and showing a thermally insulated basin for holding the liquid cryogen, which basin is pivotally disposed within the thermally insulated tunnel of the freezer.

The construction of the basin 111 itself is also a further contribution of the retarding of evaporation of liquid cryogen. As best seen in FIG. 5, the basin 111 is made up of double-wall metal construction, using a suitable metal such as stainless steel, with the interior space between an inner metal wall 171 and an outer metal wall 173 being filled with a thermal insulating material, such as foam polyurethane. Also depicted in FIG. 5 is the insulated bottom wall 177 of the extension section 94 of the tunnel and its side panels 179, all of which are also made of thermal insulating material. The outer surfaces of the bottom wall 177 and the side panels 179 are exposed to ambient temperatures, and therefore there is always some heat flow into the apparatus when cryogenic temperatures are being maintained interior thereof. The heat is generally carried by convection within the extension section 94, and by insulating the bottom and side walls of the reservoir 111, it has been surprisingly found that the undesirable evaporation of liquid cryogen during idle conditions is very substantially lowered. Such a result was unexpected insofar as the reservoir was already being maintained within a thermally insulated enclosure. This effect can contribute substantially to the economy of operation.

The ability to easily clean any apparatus that is being operated with food products is, of course, an important feature, and the close proximity that is desired beteen the first conveyer 103 and the walls of the basin 111 would make such cleaning difficult. This difficulty is overcome by mounting the basin 111 so that it pivots from its upstream end on a pivot point 181. In its operative position, as shown in FIG. 4, its downstream end is latched into position via a latch 183, in which position its main bottom wall is inclined at an angle nearly parallel to the conveyer 103. For cleaning purposes, uplatching of the latch 183 allows the basin to pivot downward to the broken line position illustrated in FIG. 4 where its downstream end rests on the bottom wall 177 of the tunnel extension and provides easy cleaning access, as depicted in FIG. 5, once the side panels 179 have been removed. Of course, the liquid cryogen in the basin 111 is removed prior to unlatching, either by providing a pump or drain for its removal or by simply allowing natural evaporation to take place.

Although the invention has been described with respect to certain preferred embodiments which constitute the best mode presently known to the inventors, it should be understood that various modifications and changes as would be obvious to those having skill in the cryogenic refrigeration art may be made without departing from the scope of the invention which is defined in the claims appended hereto.

Particular features of the invention are emphasized in the claims which follow:

What is claimed is:

1. A cryogenic freezer comprising a thermally insulated tunnel-like enclosure having an entrance and an exit, means for conveying products being frozen from said entrance to said exit, means for contacting products being frozen with liquid cryogen at a region generally near said entrance, blower means located in an upper region of said enclosure at a location closer to said entrance than to said exit having a fan blade mounted for rotation about a generally vertical axis, additional blower means mounted in said enclosure downstream of said blower means for circulating the cryogenic vapor within said enclosure in a direction transverse to the direction of said conveying means, upstream and downstream baffle means associated with said blower means and linked together for complementary movement so as to selectively regulate the upstream flow of vapor and the downstream flow of vapor resulting from said blower means discharge to the respective extents desired, and means for monitoring the temperature of vapor leaving the region of said entrance and adjusting the orientation of said baffle means in accordance with the temperature monitored.

2. A cryogenic freezer in accordance with claim 1 wherein said means for contact with liquid cryogen constitutes means for maintaining a reservoir of liquid cryogen and wherein said conveying means contains a section which travels through said reservoir.

3. A cryogenic freezer in accordance with claim 2 wherein said blower means is located generally above said reservoir and a fan blade thereof is rotated to suck vapor upward therefrom and discharge vapor generally radially outward therefrom as directed by said movable baffle means.

4. A cryogenic freezer in accordance with claim 3 wherein said blower means is rotated by a variable speed motor and means is provided for slowing the speed of said motor whenever products to be frozen are not traveling on said conveyer means.

5. A conveyer belt in accordance with claim 2 wherein tank means is provided for holding said liquid cryogen reservoir and wherein said tank means is thermally insulated so as to substantially retard the entry of heat into said liquid cryogen through the bottom or the side walls of said tank means.

6. A cryogenic freezer in accordance with claim 5 wherein said tank means includes a metal shell filled with insulating foam material.

7. A cryogenic freezer in accordance with claim 6 wherein said tank means is pivotally mounted near one end thereof so that it can be swung from an operative position to an inoperative or cleaning position.

8. A cryogenic freezer in accordance with claim 2 wherein said blower means is located just downstream from said reservoir and a fan blade thereof is rotated to direct vapor downward therefrom and to suck vapor from locations upstream and downstream thereof as directed by said movable baffle means.

9. A cryogenic freezer in accordance with claim 8 wherein said blower means is rotated by a variable speed motor and means is provided for slowing the speed of said motor whenever products to be frozen are not traveling on said conveyer means.

10. A cryogenic freezer in accordance with claim 1 wherein said upstream baffle means and said downstream baffle means each contain a pair of upper and lower baffles which extend substantially across said enclosure with said lower baffles of each pair extending below the level of said blower means and wherein said upper and lower baffles of each pair are mechanically interconnected so that when said lower baffle is disposed in about a vertical orientation, said upper baffle is disposed in an orientation most closely approaching horizontal.

11. A cryogenic freezer in accordance with claim 10 wherein a mechanical linkage interconnects said upstream and downstream baffle means so that when said downstream lower baffle is disposed in about a vertical orientation, said upstream lower baffle is disposed in its orientation most closely approaching horizontal.

12. A cryogenic freezer for freezing food products comprising a tunnel-like enclosure having an enclosure and an exit and having thermally insulated side, top and bottom walls, a tank located within said enclosure for holding a reservoir of liquid cryogen, said tank having thermally insulated side and bottom walls, with said tank insulated walls being spaced above said enclosure insulated bottom wall and inward from said enclosure insulated side walls, means for conveying products being frozen from said entrance to said exit, said conveying means containing a section which travels through said reservoir, and blower means mounted in said enclosure for circulating cold cryogenic vapor which is created by vaporization of cryogenic liquid in said tank, whereby the presence of cold cryogenic vapor between said insulated bottom and side walls of said tank and said insulating bottom and side walls of said enclosure substantially retards the entry of heat into liquid cryogen in said reservoir through the bottom or the side walls of said tank thereby increasing efficiency.

13. A cryogenic freezer in accordance with claim 12 wherein said tank includes a metal shell filled with insulating foam material and is pivotally mounted near one end thereof so that it can be swung from an operative position downward into said space to an inoperative cleaning position.

14. A cryogenic freezer in accordance with claim 12 wherein said tank is located generally adjacent said entrance, wherein separate means is provided for supplying food products to be frozen to an upstram end of said tank through said entrance, and wherein means for supplying liquid cryogen to said tank is provided which creates downstream movement along the surface of said liquid cryogen reservoir to assure that incoming food products delivered through said entrance to said upstream end of said tank reach said conveyor means which removes the food products from the downstream end of said tank.

15. A cryogenic freezer comprising a thermally insulated tunnel-like enclosure having an entrance and an exit, means for conveying products being frozen from said entrance to said exit, means for contacting products being frozen with liquid cryogen at a region located between said entrance and said exit and thereby creating cryogen vapor at said contact region, a blower located in an upper region of said enclosure adjacent said contact region and having a fan blade mounted for rotation about a generally vertical axis, upstream and downstream baffle means associated with said blower and linked together for complementary movement so as to respectively regulate the flow of vapor from said blower in upstream and downstream directions, means for monitoring a condition of the atmosphere which is indicative of the atmosphere in said enclosure in the region of said entrance, and means for adjsuting the orientation of said baffle means in accordance with the condition monitored to avoid undesirably large amount of vapor from exiting said enclosure via said entrance.

16. A cryogenic freezer in accordance with claim 15 wherein additional blower means is mounted in said enclosure downstream of said blower for causing the cryogenic vapor within said enclosure to flow in a direction transverse to the direction of said conveying means.

17. A cryogenic freezer in accordance with claim 15 wherein said means for contacting with liquid cryogen constitutes a tank located near said entrance and means for maintaining a reservoir of liquid cryogen in said tank, and wherein said conveying means contains a section which travels through said reservoir.

18. A cryogenic freezer in accordance with claim 17 wherein said blower is located generally above said reservoir and said fan blade thereof is rotated to suck vapor upward therefrom and discharge vapor generally radially outward therefrom as directed by said movable baffle means.

19. A cryogenic freezer in accordance with claim 17 wherein said blower is located just downstream from said reservoir and said fan blade thereof is rotated to direct vapor downward therefrom and to suck vapor from locations upstream and downstream thereof as directed by said movable baffle means.

20. A cryogenic freezer in accordance with claim 15 wherein means is provided for exhausting atmosphere from a location adjacent said entrance and wherein said monitoring means monitors the temperature of the atmosphere being exhausted.

* * * * *

UNITED STATES PATENT AND TRADEMARK OFFICE

CERTIFICATE OF CORRECTION

PATENT NO. : 4,783,972

DATED : November 15, 1988

INVENTOR(S) : Lewis Tyree, Jr., et al.

It is certified that error appears in the above-identified patent and that said Letters Patent is hereby corrected as shown below:

IN THE SPECIFICATION:

Column 1, line 34, Change "if" to --is--.
Column 2, line 10, Correct the spelling of --main--.
Column 3, line 4, Correct the spelling of --which--.
Column 3, line 34, Change "this" to --that--.
Column 3, line 51, Change "is" to --if--.
Column 4, line 24, Delete "as".
Column 5, line 35, Change "FIGJ. 3" to --FIG. 3--.
Column 5, lines 57-58, Correct the spelling of --temperature--.
Column 7, line 38, Correct the spelling of --initially--.
Column 8, line 20, Correct the spelling of --evacuated--.
Column 9, line 34, Change "of" to --to--.
Column 9, line 59, Correct the spelling of --between--.
Column 9, lines 67-68, Correct the spelling of --unlatching--.

IN THE CLAIMS:

Claim 12, Column 11, line 41, Change "enclosure (second occurrence)" to --entrance--.

Claim 14, Column 12, line 6, Correct the spelling of --upstream--.

UNITED STATES PATENT AND TRADEMARK OFFICE

CERTIFICATE OF CORRECTION

PATENT NO. : 4,783,972

DATED : November 15, 1988

INVENTOR(S) : Lewis Tyree, Jr., et al.

It is certified that error appears in the above-identified patent and that said Letters Patent is hereby corrected as shown below:

Claim 15, Column 12, line 35, Correct the spelling of --adjusting--.

Claim 15, column 12, line 37, Change "amount" to --amounts--.

Signed and Sealed this

Twenty-third Day of May, 1989

*Attest:*

DONALD J. QUIGG

*Attesting Officer*

*Commissioner of Patents and Trademarks*